US007997774B2

(12) United States Patent
Liddle

(10) Patent No.: US 7,997,774 B2
(45) Date of Patent: Aug. 16, 2011

(54) LIGHT SYSTEM HAVING MAGNETICALLY ATTACHABLE LIGHTING ELEMENTS

(76) Inventor: Richard Graham Liddle, Newcastle (GB)

( * ) Notice: Subject to any disclaimer, the term of this patent is extended or adjusted under 35 U.S.C. 154(b) by 114 days.

(21) Appl. No.: 11/884,137

(22) PCT Filed: Feb. 7, 2006

(86) PCT No.: PCT/GB2006/050030

§ 371 (c)(1),
(2), (4) Date: Aug. 9, 2007

(87) PCT Pub. No.: WO2006/085117

PCT Pub. Date: Aug. 17, 2006

(65) Prior Publication Data

US 2008/0151542 A1 Jun. 26, 2008

(30) Foreign Application Priority Data

Feb. 10, 2005 (GB) ..... 0502725.5

(51) Int. Cl.
*F21V 21/096* (2006.01)
*F21V 21/13* (2006.01)
*F21V 21/14* (2006.01)

(52) U.S. Cl. ..... 362/398; 362/240; 362/249.02; 362/249.11

(58) Field of Classification Search ..... 362/103, 362/108, 240, 249.02, 249.11, 249.14, 398
See application file for complete search history.

(56) References Cited

U.S. PATENT DOCUMENTS 3,283,143 A 11/1966 Gosnell
5,607,225 A 3/1997 Halvatzis
6,810,612 B2 * 11/2004 Huang ..... 40/452

* cited by examiner

*Primary Examiner* — Ismael Negron

(57) ABSTRACT

A lighting element (1) comprises at least one light (3), means (13) for delivering electricity to the or each light, a pair of spaced apart plates (2,2'), at least one magnet (4,4') located between the said plates and biasing means (8) for biasing the said plates apart, wherein a magnet (4) is attached to one of the pair of plates. In use the lighting element forms part of a lighting system in which the element is located between spaced apart transparent sheets (10), e.g. panes of glass.

17 Claims, 6 Drawing Sheets

LIGHT SYSTEM HAVING MAGNETICALLY ATTACHABLE LIGHTING ELEMENTS

FIELD OF THE INVENTION

The invention relates to a lighting system, and in particular to a lighting system where a lighting element is mounted between transparent planar sheets.

BACKGROUND OF THE INVENTION

Low voltage lighting is used within commercial and domestic environments, usually to produce lighting effects. Typically, low voltage lighting units consist of fixed assembled structures that are positioned and wired within the area required to be lit. Once positioned, the lighting units are stationary and rarely re-positioned.

Attempts have been made to make low voltage lighting units more flexible by providing for movement of lighting units relative to a supply of electricity.

DE 19826530 describes a lighting unit in which a low voltage lamp is slidably mounted on a rail. The supply of electricity is arranged such that the lamp is supplied with electricity at any position on the rail. Once a user has decided on the desired location of the lamp, the lamp is held in place by magnetic attraction between a magnet arrangement in the lamp assembly and the rail.

DE 4014818 describes a low voltage lighting system comprising parallel conductor rails, which supports one or more lamps and feeds electricity to them. The lamps can be moved along the rails and are held in place by a bar-magnet, which also forms an electrical contact.

Another lighting device is described in French patent application no 2,836,985. The lighting device of this patent comprises a lighting element mounted between an electrically conductive transparent surface and another electrically conductive surface. Electricity from the respective electrically conductive surfaces power the lighting element mounted therebetween. The lighting element includes two contacts each in electrical connection with one of the said electrically conductive surfaces. One of the contacts consists of a brush contact filament. The lighting element includes at least one magnet situated substantially adjacent to a backing plate. The lighting unit is held in place by a magnet aligned with the magnet of the lighting element, but on the other side of the backing plate. The lighting element may be moved by moving the magnet on the other side of the backing plate, and a hand-grip is provided to facilitate this.

There is a need for an improved lighting arrangement

SUMMARY OF THE INVENTION

The lighting system of the present invention provides a convenient means of lighting in which the lighting elements are mounted between transparent sheets and can be moved easily from one position to another simply by aligning magnets located outside the sheets with the lighting element. The magnets located outside the transparent sheet are attracted to magnets forming part of the lighting unit. The attraction of the magnets causes part of a plate mounting the lights to be pulled out of contact with an inner surface of one of the transparent sheets. This allows the lighting element to be re-positioned within the space between the sheets. The gravity switch allows the lighting elements to be switched on and off simply by rotating them.

The electrical power supply to the lighting element may be low voltage direct current or an alternating current from a mains supply, i.e. for the UK 240 volts at 60 Hz.

BRIEF DESCRIPTION OF THE DRAWINGS

In the drawings, which illustrate preferred embodiments of a lighting arrangement according to the invention.

DETAILED DESCRIPTION OF THE PREFERRED EMBODIMENTS

Figure 1:
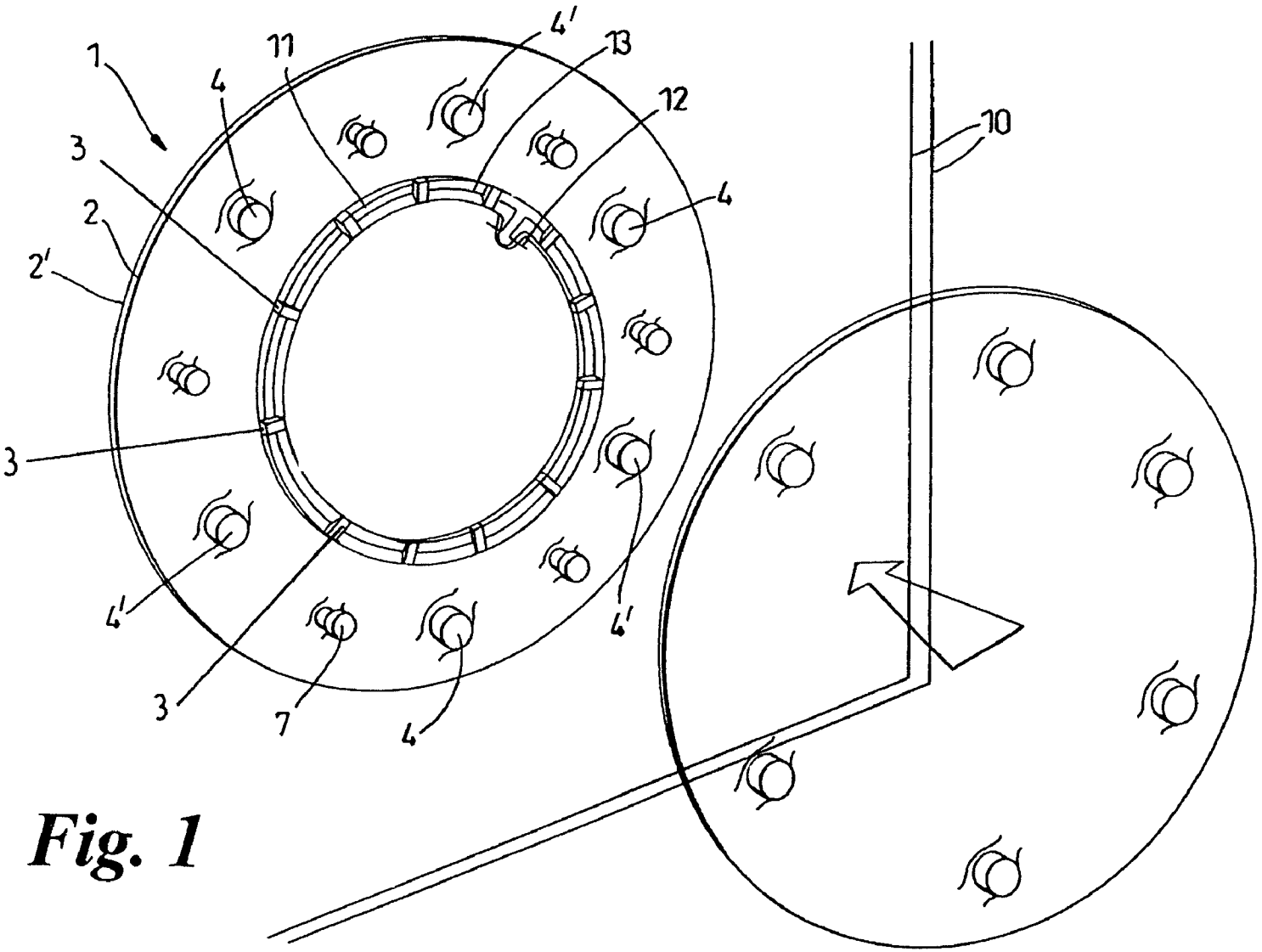
FIG. 1 is a schematic representation of a lighting system according to the invention mounted between panes of glass.

Referring now to FIG. 1, a lighting element 1 is mounted between a pair of spaced apart glass panes 10. The glass panes are conductive of electricity. In the example, the inner surface of each glass pane is coated with an electrically conductive layer 9. The lighting element 1 includes a plurality of light emitting diodes (LED's) 3. The central portion of each of the plates 2, 2' is cutaway, with a ring mounting a plurality of LED's being mounted in the ring 11. The thickness of the ring 11 is slightly smaller than the distance between the outside walls of the plates 2, 2'. The ring 11 also mounts an electrical contact element 12, which is so dimensioned that the ends thereof brush the electrically conductive inner surfaces of the panes 10. Power is delivered to the LED's via the electrical contact element 12 and wires 13. The contact elements 12 may take the form of a single conductive polymer.

Figure 3:
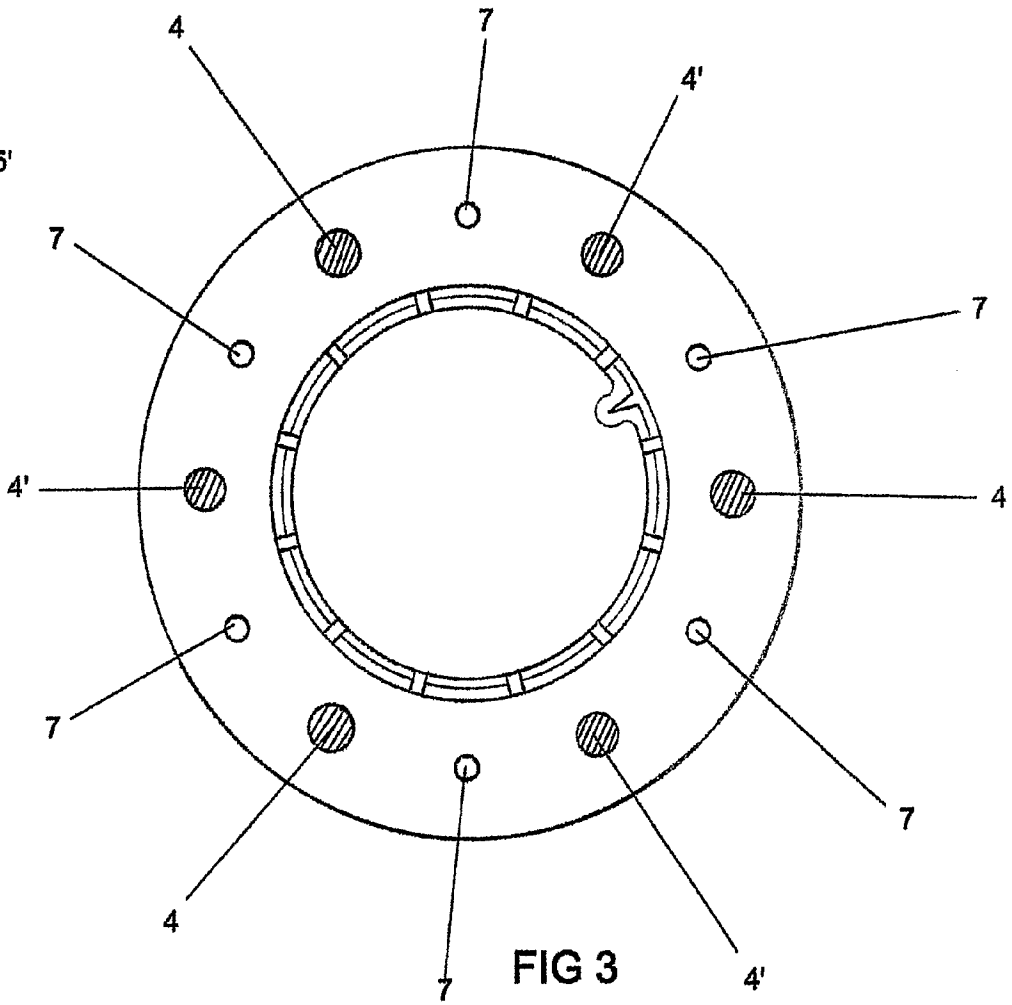
FIG. 3 is a front view of the lighting element illustrated in FIGS. 2 and 3.
Figure 2:
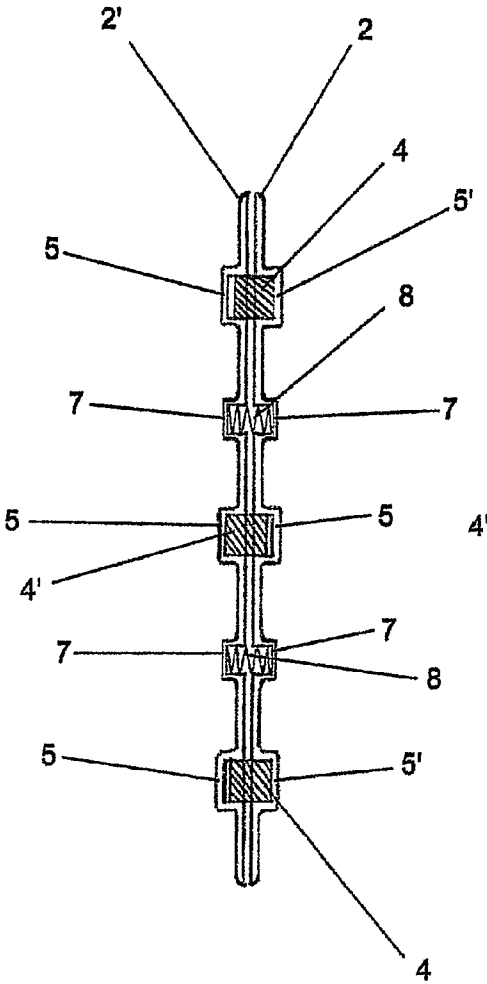
FIG. 2 is a cross-sectional elevation of a lighting element of the system in FIG. 1.

Referring now to FIGS. 1 to 3, magnets 4 and 4' are arranged in recesses 5 in the plates 2, 2'. The magnets 4 and 4' are bonded to a respective one of the plates 2, 2'. In particular, magnets 4 are bonded to the plate 2 and magnets 4' are bonded to the plates 2'. The plates 2 and 2' include further recesses 7, which are aligned as can be seen from FIG. 2. Compression springs 8 are located in the recesses 7 and serve to force apart the plates 2, 2'. The compression springs 8 may take the form of compressed foam, sponge or a plastics material. Where the springs 8 are formed from a plastics material, the springs 8 may be formed as part of the vacuum forming of one of the plates 2, 2'.

Figure 5:
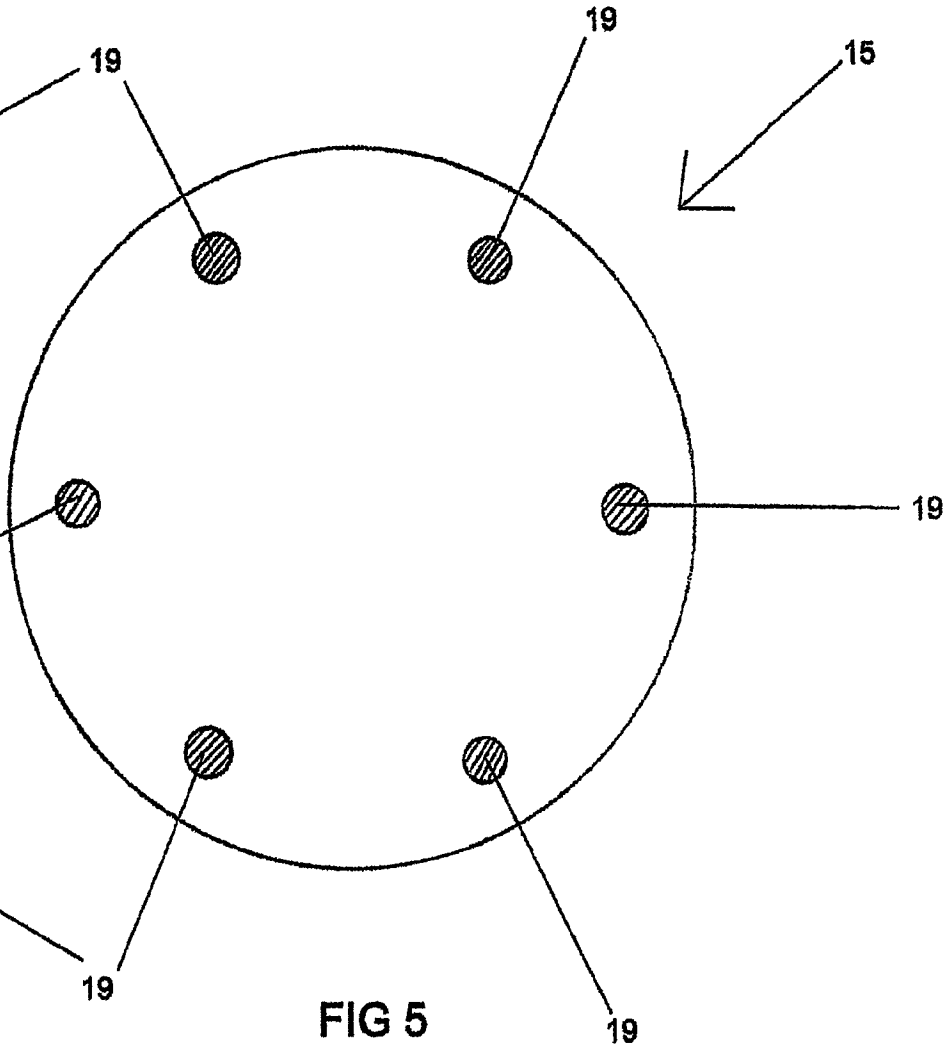
FIG. 5 is a front view of the lens illustrated in FIG. 4.
Figure 4:
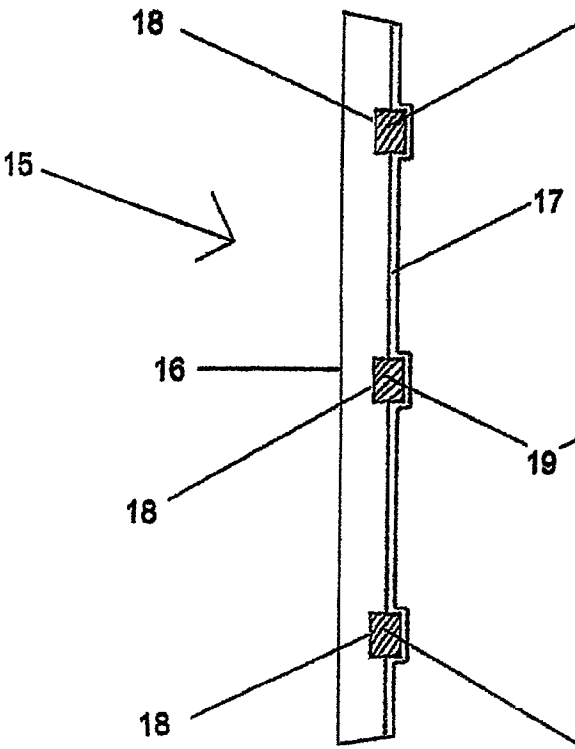
FIG. 4 is a side view of a lens of the lighting system illustrated in FIG. 1.

FIGS. 4 and 5 illustrate a lighting element moving means in the form of a lens unit 15. The lens unit 15 comprises a lens 16 to which is attached a backing plate 17. The lens 16 includes recesses 18 in which magnets 19 sit The magnets 19 are enclosed by the lens 16 on one side and the backing plate 17 on the other. Alternatively, the lens unit 15 may be cast as a single part with the magnets 19 embedded therein.

Figure 6:
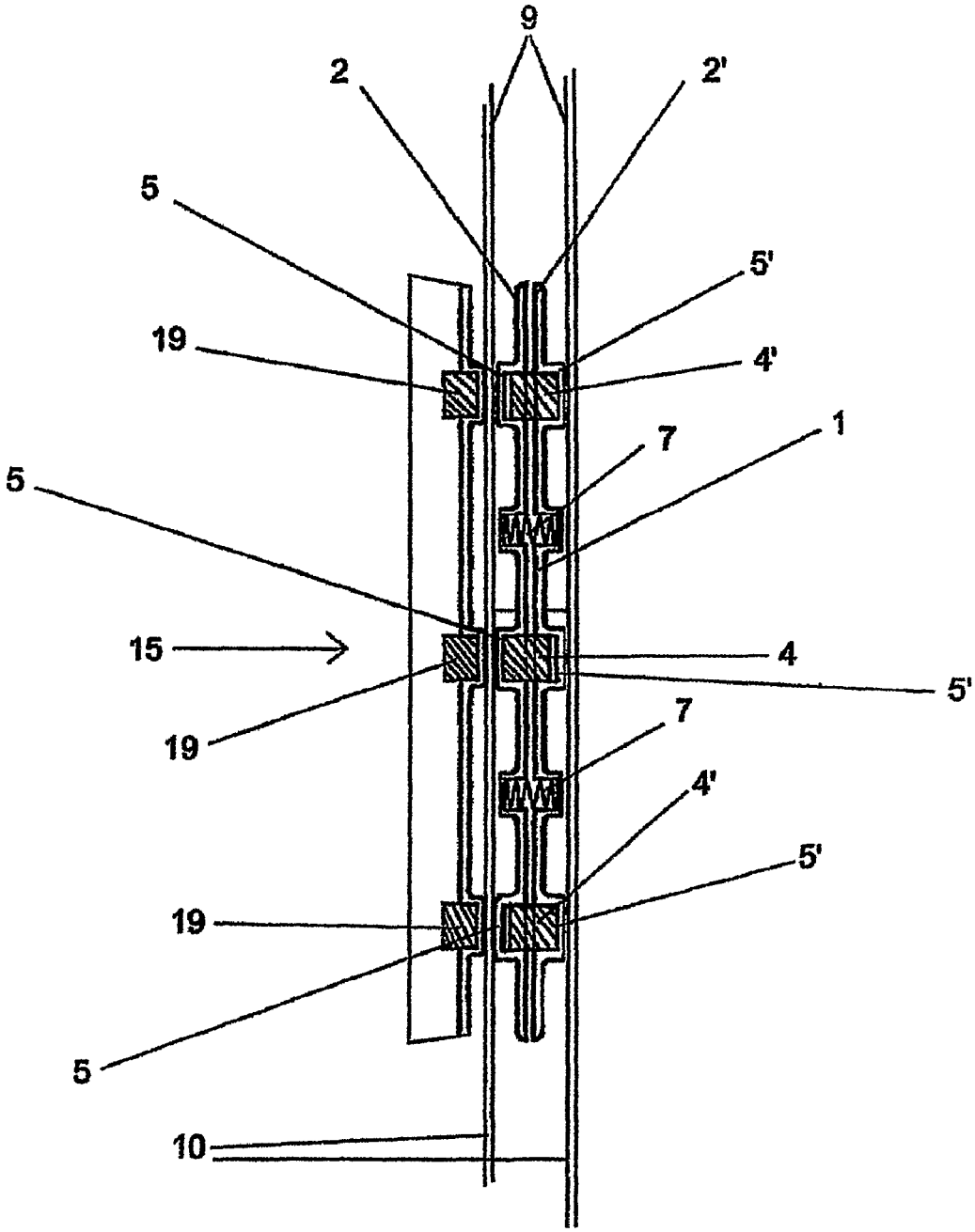
FIG. 6 is a cross-sectional elevation of the lighting system illustrated in FIG. 1.

As illustrated in FIG. 6, the lens unit 15 is mounted on the outside of a glass pane 10, and is aligned with a lighting element 1. The magnets 19 of the lens unit 15 are attracted to the magnets 4, 4' of the lighting element 1. In this configuration the plate 2' is caused to bend so that the outer surface of recesses 5' are pulled away from the inner surface of the glass pane 10, against the force of the springs 7. The reduction in friction is sufficient to allow the lighting element 1 to be moved about within the glass panes 10 by a person grasping and moving the lens unit 15.

When the lens unit 15 is removed, the action of the springs 7 forces the plates 2, 2' apart so that the outer surfaces of recesses 5, 5' press against the inner surfaces of the glass panes 10.

Figure 9:
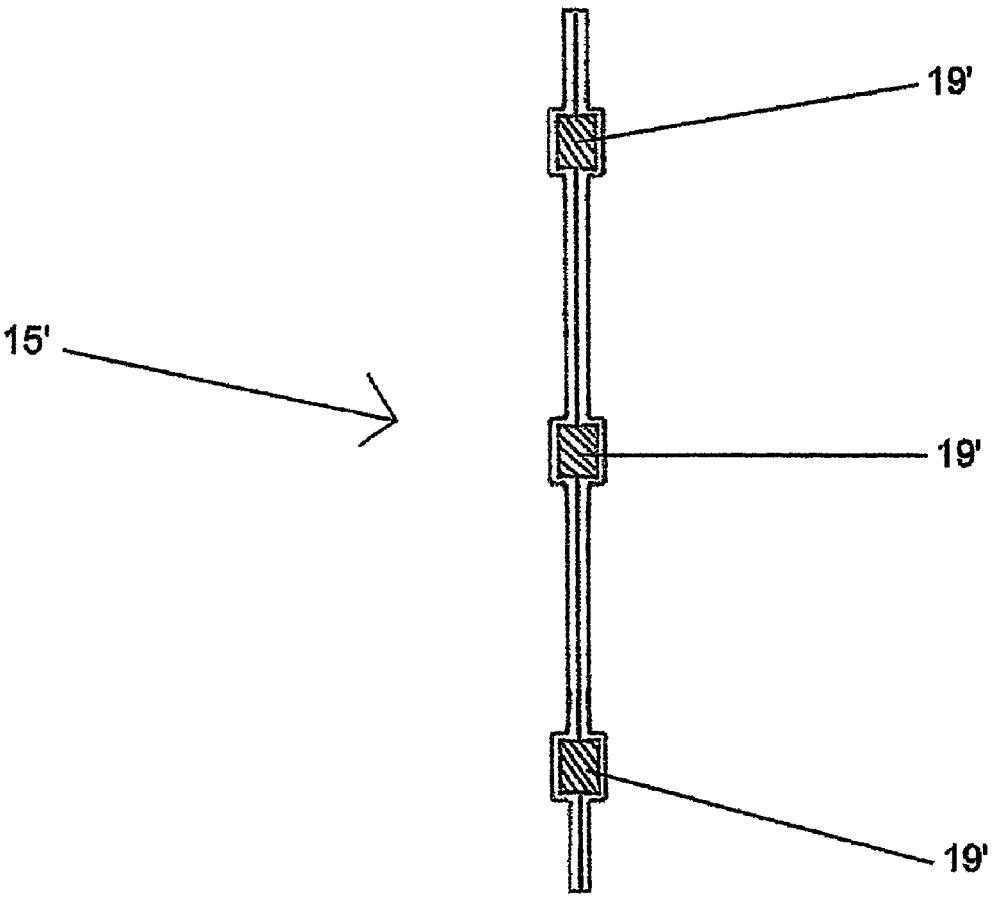
FIG. 9 is a side view of a second embodiment of a lens.

FIG. 9 illustrates a second embodiment of a lighting element moving means, in the form of a lens 15' in which both sides of magnets 19' may be aligned with a lighting unit The magnetic surfaces of the magnets 19' have north and south polarities respectively. Equally, the magnets 4, 4' have respective north and south polarities. The lens 15' of FIG. 9 can be used to move the lighting unit from either side of the glass panes 10 by presenting one side or the other of the lens 15' to a respective side of the glass panes 10.

Figures 7, 8:
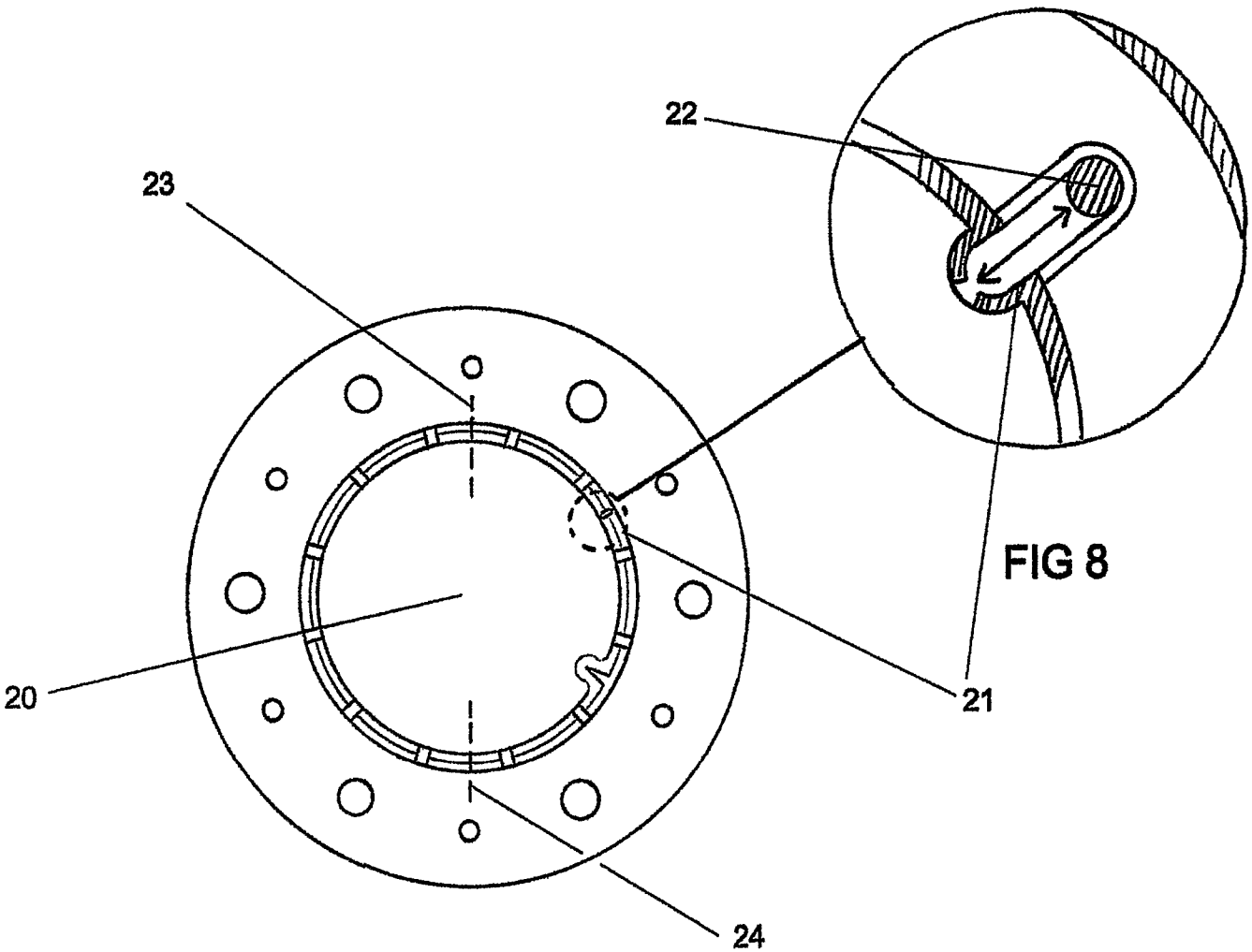
FIG. 7 is a front view of an alternative embodiment of a lighting element.
FIG. 8 is a schematic representation of a switch.

The lighting element 20 illustrated in FIGS. 7 and 8 includes a switch 21. The switch is in the form of an electrically conductive ball bearing 22, which is movable between open and closed positions. The switch is operated by rotating the lighting element 20 so that the position of the switch element changes. The position of the ball bearing is controlled by gravity. When the switch 21 is less than 90 degrees away from top dead centre 23, the switch is closed and electricity is conducted to the LED's. When the switch 21 is less than 90 degrees from bottom dead centre 24 the switch 21 is open and the LED's are off. The gravity switch allows the lighting elements to be switched on and off simply by rotating them. This switch may also take the form of a mercury reed switch.

In the example, the LED's are powered by a battery or by mains electricity through a transformer. The lighting system of the invention may include solar energy collectors for collecting solar energy and converting the collected energy into electricity. Such electricity would be stored in a suitable storage device, such as a rechargeable battery, for use by the LED's when outside light conditions have dimmed.

In use, a lighting system may comprise two spaced apart panes of glass 10 with a plurality of lighting elements located therebetween. Each lighting element 1 may be provided with a lens unit 15, alternatively only one or some of the lighting elements 1 may be provided with a lens unit 15. Where fewer lens units than lighting elements are provided, it may be necessary to remove a lens unit 15 from one lighting element 1 and move the lens unit to another lighting element, for example if the other lighting unit is to be moved. Alternatively, the lighting element moving means may not be a lens, and may be used simply to move the lighting elements from one location to another. In this alternative, it would be normal to provide fewer moving means than lighting elements.

The invention claimed is:

1. A lighting system comprising:

a lighting element, including at least one light, means for delivering electricity to the at least one light, a pair of spaced apart plates, at least one first magnet located between said plates, and biasing means for biasing said plates apart;

a lighting element moving means;

a pair of spaced apart sheets, each sheet being one of transparent and two way mirrored, each sheet being provided with an electrically conductive layer for delivering power to the lighting element;

wherein the at least one first magnet is attached to one of the pair of plates and a first one of the pair of plates is movable relative to a second one of the pair of plates, and wherein the lighting element is movably mounted between the sheets and the means for biasing force outer surfaces of the plates into contact with inner surfaces of the sheets.

2. A lighting system according to claim 1, wherein the at least one light is mounted on a light mount supported by the said pair of plates of the lighting element.

3. A lighting system according to claim 1, the lighting element comprising a plurality of lights.

4. A lighting system according to claim 1, wherein the said at least one light is a light emitting diode.

5. A lighting system according to claim 1, wherein the at least one biasing means comprises a compression spring.

6. A lighting system according to claim 1, wherein aligning the at least one second magnet with the at least one first magnet causes one of the plates to be pulled towards the moving means and away from the inner surface of one of the sheets against the biasing force of the said biasing means.

7. A lighting system according to claim 1, wherein the lighting element moving means is a lens unit.

8. A lighting system according to claim 1, comprising a plurality of lighting elements and at least a single lens unit.

9. A lighting system according to claim 1, wherein at least one magnet housing is formed in each of the said pair of plates of the lighting element, the at least one magnet housing of one plate being substantially aligned with a magnet housing of the other plate, and wherein a magnet is located in the at least one magnet housing.

10. A lighting system according to claim 9, wherein a magnet located in a magnet housing of one plate of the pair and attached to that plate is slidably located in a magnet housing of the other plate of the pair.

11. A lighting system according to claim 1, wherein at least one biasing means housing is formed in each of the said pair plates of the lighting element, the at least one biasing means housing of one plate being substantially aligned with a biasing means housing of the other plate, and wherein a biasing means is located in the at least one biasing means housing.

12. A lighting system according to claim 11, wherein at least one magnet housing is formed in each of the said pair of plates of the lighting element, at least one magnet housing of one plate being substantially aligned with a magnet housing of the other plate, and wherein a magnet is located in the at least one magnet housing, and wherein the at least one biasing means extend between and are located in biasing means housings of each of the pair of plates.

13. A lighting system according to claim 1, further comprising a switch for connecting and disconnecting electrical power to the light.

14. A lighting system according to claim 13, wherein the switch is selected from a gravity switch and a mercury reed switch.

15. A lighting system according to claim 1, wherein the plates of the lighting element are formed from a material selected from a transparent plastics material and an opaque plastic material.

16. A lighting system according to claim 1, wherein the lighting element moving means includes at least one second magnet having a polarity opposing that of the at least one first magnet attached to the lighting element wherein the first one of the pair of plates of the lighting element is adapted to move towards the second one of said pair of plates against a biasing force generated by the biasing means when the second magnet is presented up to the first magnet and aligned therewith.

17. A lighting system according to claim 16, wherein the moving means has two faces, and wherein the at least one second magnet extends axially between the two faces such that each of the two faces of the moving means includes a surface of the second magnet.

* * * * *